US006594976B1

(12) United States Patent
Chikamitsu et al.

(10) Patent No.: US 6,594,976 B1
(45) Date of Patent: Jul. 22, 2003

(54) PACKAGING DEVICE

(75) Inventors: Jun Chikamitsu, Yamaguchi (JP); Ryozo Matsumoto, Yamaguchi (JP)

(73) Assignee: Kohan Kogyo Co., Ltd., Yamaguchi (JP)

( * ) Notice: Subject to any disclaimer, the term of this patent is extended or adjusted under 35 U.S.C. 154(b) by 0 days.

(21) Appl. No.: 09/890,327

(22) PCT Filed: May 31, 1999

(86) PCT No.: PCT/JP99/02886

§ 371 (c)(1),
(2), (4) Date: Nov. 7, 2001

(87) PCT Pub. No.: WO00/44623

PCT Pub. Date: Aug. 3, 2000

(30) Foreign Application Priority Data

Jan. 29, 1999 (JP) ..... 11/022286

(51) Int. Cl.[7] ..... B65B 13/04

(52) U.S. Cl. ..... 53/589; 53/409; 53/204; 100/12

(58) Field of Search ..... 100/12, 26; 53/204, 53/409, 589

(56) References Cited

U.S. PATENT DOCUMENTS 1,394,266 A * 10/1921 Angier ..... 53/409
4,578,925 A * 4/1986 Matsunami ..... 53/409
5,540,142 A * 7/1996 Mieleszuk et al. ..... 100/4
5,755,083 A * 5/1998 Cleine ..... 53/588
6,324,820 B1 * 12/2001 Gelfman et al. ..... 53/588

FOREIGN PATENT DOCUMENTS

JP 48-87997 * 1/1973
JP 2-72011 * 2/1990

* cited by examiner

*Primary Examiner*—Rinaldi I. Rada
*Assistant Examiner*—Hemant M Desai
(74) *Attorney, Agent, or Firm*—Browdy and Neimark, P.L.L.C.

(57) ABSTRACT

The object of the present invention is to provide a packaging apparatus that supplies the packaging material by the packing material supply means provided independently of the mobile body that moves along the annular guide body. In order to achieve the object, the packaging apparatus of the present invention comprises a mobile body for leading a packaging material, an annular guide body for guiding said mobile body along said annular guide body, mobile body drive means for moving the mobile body along the annular guide body, and packaging material supply means disposed outside said annular guide body.

12 Claims, 5 Drawing Sheets

PACKAGING DEVICE

REFERENCE TO RELATED APPLICATIONS

The present application is the national stage under 35 U.S.C. 371 of international application PCT/JP99/02886, filed May 31, 1999, which designated the United States, and which application was not published in the English language.

TECHNICAL FIELD

The present invention generally relates to a packaging apparatus for packaging an object with a packaging material, and more specifically, to a packaging apparatus for winding an elastic film on the roll sheet steel.

BACKGROUND ART

In general, a packaging apparatus disclosed in Japanese Patent Laid-Open No.294314/1993 is known as an apparatus for packaging an annular object, for example, a coil of a metal banded body.

This type of packaging apparatus comprises a loop body including two beams and a gate section that can be opened and closed with respect to these beams, and a shuttle is disposed along the inner peripheral surface of the loop body in such a manner that it orbits along the inner periphery of the loop body. The shuttle is crawler-type by the use of an electric motor, and including roll packaging material therein.

Operation of such an apparatus comprises the steps of opening the gate section of the loop body, setting a hoop coil to the loop body so that a beam of the loop body passes through the hole of the hoop coil to be packaged, closing the gate section, then pulling the packaging material out from inside the shuttle and fixing the tip thereof to the hoop coil, and subsequently moving the shuttle along the loop body while rotating the hoop coil to wind the packaging material from inside the shuttle on the hoop coil.

However, since the packaging apparatus of the related art is constructed in such a manner that a packaging material is accommodated in the shuttle that has to orbit around the limited internal space of the loop body and to pass through the further limited space, or the hollow in the hoop coil, the quantity of the packaging material that can be accommodated within the shuttle has no other choice but to be extremely limited.

Therefore, in the above-described packaging apparatus of the related art, disadvantageously, the packaging material within the shuttle has to be refilled quite often. In addition, since the material is accommodated within the shuttle, the refilling work of the packaging material is quite complicated.

With the problem described above in view, it is an object of the present invention to provide a packaging apparatus in which the packaging material is supplied by the packaging material supply means independently of the mobile body moving along the annular guide body.

DISCLOSURE OF INVENTION

In order to solve the problem described above, a packaging apparatus of the present invention comprises a mobile body for leading the packaging material, an annular guide body for guiding the mobile body, a mobile body drive means for moving the mobile body along the annular guide body, and a packaging material supply means arranged outside the annular guide body.

According to the packaging apparatus of the construction described above, when the object to be packaged is placed in the internal space of the annular guide body, and the mobile body is moved along the annular guide body by means of the mobile body drive means with the packaging material from the packaging material supply means attached to the object to be packaged, the mobile body moves around the object to be packaged while leading the packaging material extending between the object to be packaged and the packaging material supply means to package the object to be packaged with the packaging material.

In the packaging apparatus having a construction as described above, since the packaging material supply means and the mobile body are separately provided, and the mobile body is not provided with a packaging material supply source in itself and the packaging material supply means is disposed outside the annular guide body, even when the packaging material supply source of the packaging material supply means disposed outside the annular guide body is increased in size, it does not cause interference of the mobile body moving along the annular guide body with the object to be packaged disposed within the internal space of the annular guide body. In other words, a large amount of packaging material can be provided in the packaging material supply means without interference of the mobile body with the object to be packaged in the internal space of the annular guide body.

In this invention, it is preferable to further provide a tension providing means for giving a tension to the packaging material being lead by the mobile body.

Preferably, the mobile body comprises a film roller chain including a plurality of film roller chains connected by connecting link with each other, the annular guide body comprises a guide track for guiding and supporting the film roller chain, and the mobile body drive means is a drive belt for moving the film roller chain with respect to the guide track.

Preferably, the tension providing means includes a tension belt to be driven by the air motor in the direction opposite to the direction in which the mobile body moves in the annular guide body, and a relief valve between the air motor and the compressed air supply of the air motor for relieving compressed air from the compressed air supply when it is not necessary to give a tension to the packaging material.

Preferably there is provided a packaging material cutting device for cutting the packaging material supplied from the packaging material supply means.

BEST MODE FOR CARRYING OUT THE INVENTION

Figure 1:
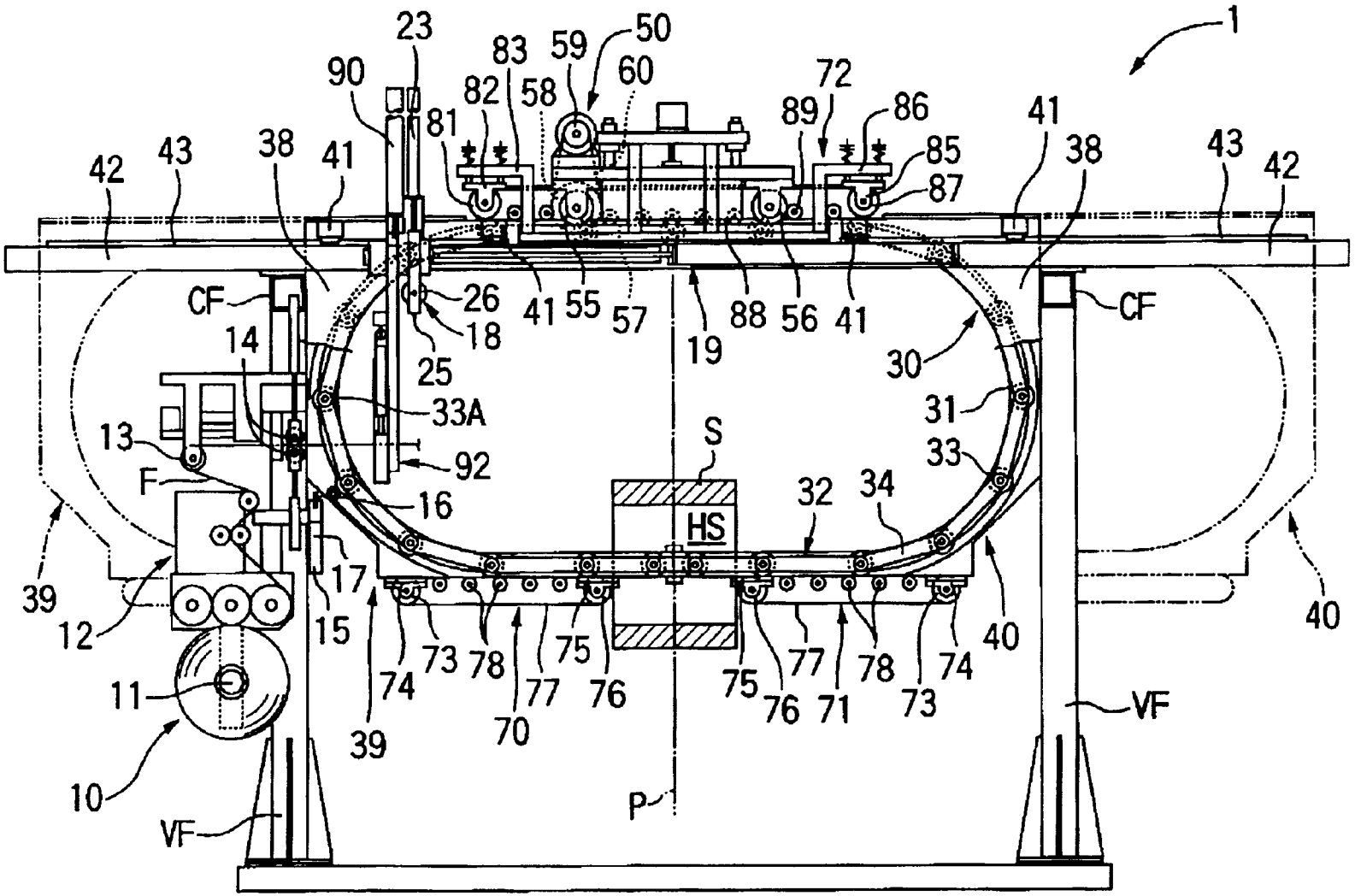
FIG. 1 is a schematic front view of a packaging apparatus of an embodiment of the present invention partly in cross section.

Referring now to the drawings, an embodiment of the present invention will be described. In this embodiment, the present invention is applied to the packaging apparatus for packaging the roll sheet steel. As shown in FIG. 1 schematically, a packaging apparatus shown generally by the reference numeral 1 comprises a packaging material supply device 10, a winding device 30 for winding the packaging material from the packaging material supply device 10 on the sheet steel roll S wound into a roll, a film roller chain drive 50 for moving the film roller chain 32 of the winding device 30 along the guide track 31, and a tension device for taking up slack of the packaging material to be wound on the steel plate S by the film roller chain 32.

Figure 2:
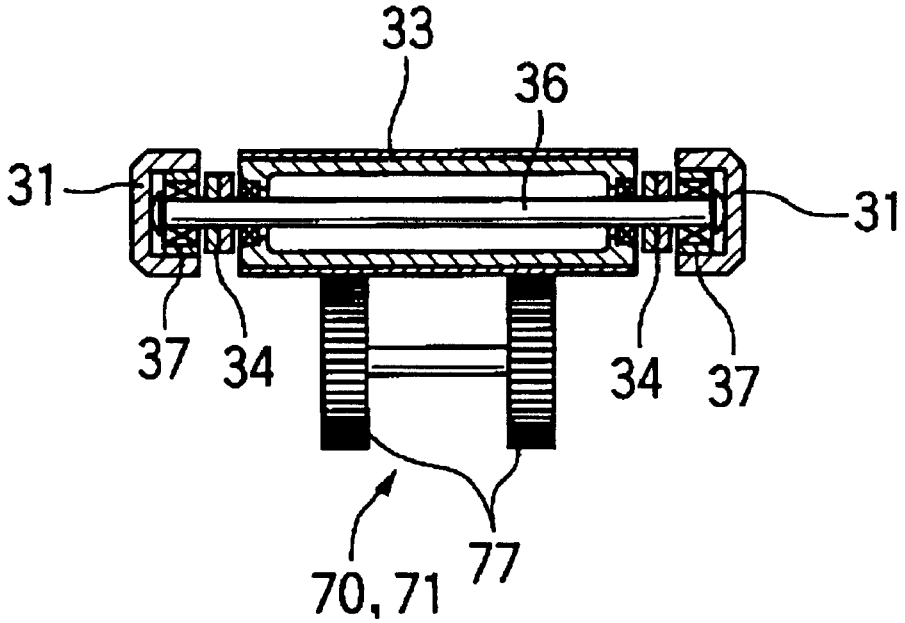
FIG. 2 is a schematic cross section of the film roller of the packaging apparatus shown in FIG. 1.

The winding device 30 includes an annular guide body for guiding the mobile body or a pair of guide tracks 31 at a distance, and each guide track 31, being C-shape in cross section opening toward the other guide track as well shown in FIG. 2, has the upper wall and the lower wall facing with respect to each other and a side wall connecting these walls. Each guide track 31 has generally an annular shape or a loop shape, and is generally oval as seen in FIG. 1, or when viewed from the front of the packaging apparatus 1, and the oval guide track 31 comprises upper and lower linear sections parallel with respect to each other and arcuate sections on the left and the right.

The guide track 31 is adapted to guide the mobile body or the film roller chain 32 freely for leading the packaging material.

The film roller chain 32 comprises a plurality of film rollers 33 and a connecting link 34 for connecting adjacent film rollers 33. As well seen in FIG. 2, the roller shaft 36 is supported by each film roller 33, and the guide rollers 37 are rotatably mounted on each end of the roller shaft 36 extending from the film roller 33 through the connecting link 34. The guide rollers 37 of the respective film rollers 35 are disposed on the guide tracks 31 facing toward each other. Therefore, film roller chain 32 can move along the guide track 31 by the movement of the guide roller 37 along the guide track 31.

The guide tracks 31 disposed so as to face toward each other are connected by a pair of connecting-backup plates 38. Each connecting-backup plate 38 is rectangular of which one side is open in cross section, and comprises a pair of opposing side plates and a connecting plate for connecting these side plates. Each guide track 31 is mounted with the side plate of the connecting-backup plate 38 on its sidewall of each arcuate section, and the opposing guide tracks 31 are connected via the connecting plate extending between the side plates of the connecting-backup plate 38.

The connected guide track 31 is divided along the central vertical plane P and constitutes two guide track halves 39, 40.

A pair of brackets are mounted on the upper outer surface of each side plate of each connecting-backup plate 38 (8 brackets in total), and each bracket is mounted with a guide slider 41. The guide track 31 (each guide track halves 39, 40) is supported by a pair of guide supporting frames 42 respectively via the guide sliders 41 of the respective connecting-backup plates 38. The respective guide supporting frames 42 extend longitudinally of the guide track 31, and are supported by the cross frame CF extending between the vertical frames VF. On the top end of each guide supporting frame 42 is formed a projecting guide rail 43, along which the guide groove formed on the bottom of the guide slider 41 is slidably guided and supported.

The guide track separating drive, or a pair of hydraulic cylinder mechanism 44, are provided adjacent to the respective guide track halves 39, 40. Each hydraulic cylinder mechanism 44 comprises a cylinder 45 fixed to the guide supporting frame 42 via the bracket so as to extend along the guide supporting frame 42 and a piston rod 46 moving in the cylinder 45. The distal end of the piston rod 46 is fixed to the connecting member 47 mounted on the outer surface of the connecting plate of the connecting-backup plate 38.

Therefore, when the piston rod 46 of each hydraulic cylinder mechanism 44 is moved so as to project from the cylinder 45, each piston rod 46 urges the guide track halves 39, 40 away from each other via the connecting member 47. The urged guide track halves 39, 40 move along the guide rail 43 via the guide slider 41 and thus a clearance for receiving the sheet steel roll S, or the object to be packaged, is provided between the guide track halves 39, 40. When the guide track halves 39, 40 have to be connected with each other for example during packaging operation, the piston rod 46 of the hydraulic cylinder mechanism 44 may be urged so as to be retracted into the cylinder 45, or the opposing ends of the guide track halves 39, 40 may be detachably locked with each other in a mechanical manner.

The mobile body driving means for moving the mobile body along the annular guide body, or the film roller chain drive 50 for moving the film roller chain 32 of the winding device 30 along the guide track 31 is disposed above the guide track 31.

Figure 3:
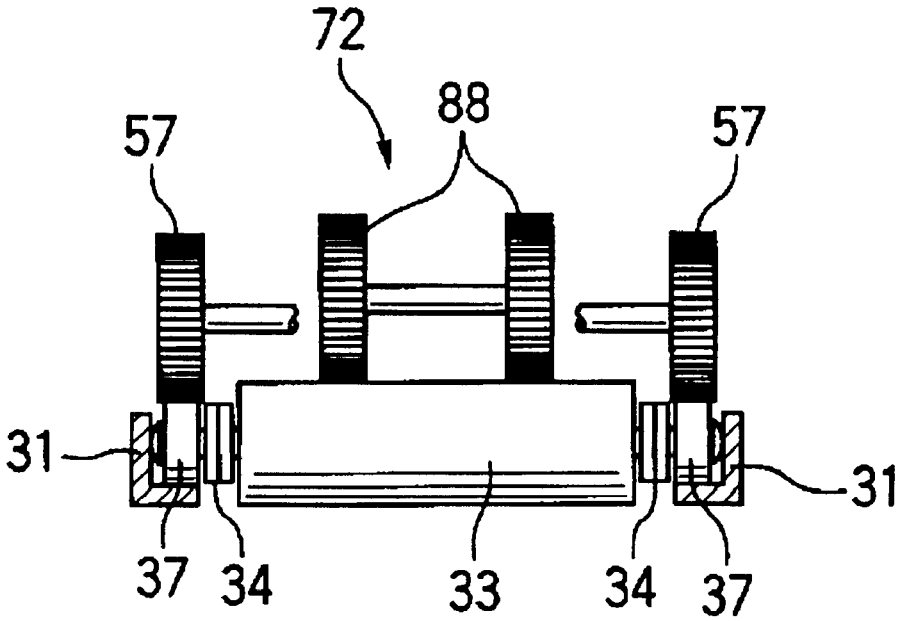
FIG. 3 is a schematic cross section of the film roller on the upper portion of the guide track of the packaging apparatus shown in FIG. 1.
Figure 4:
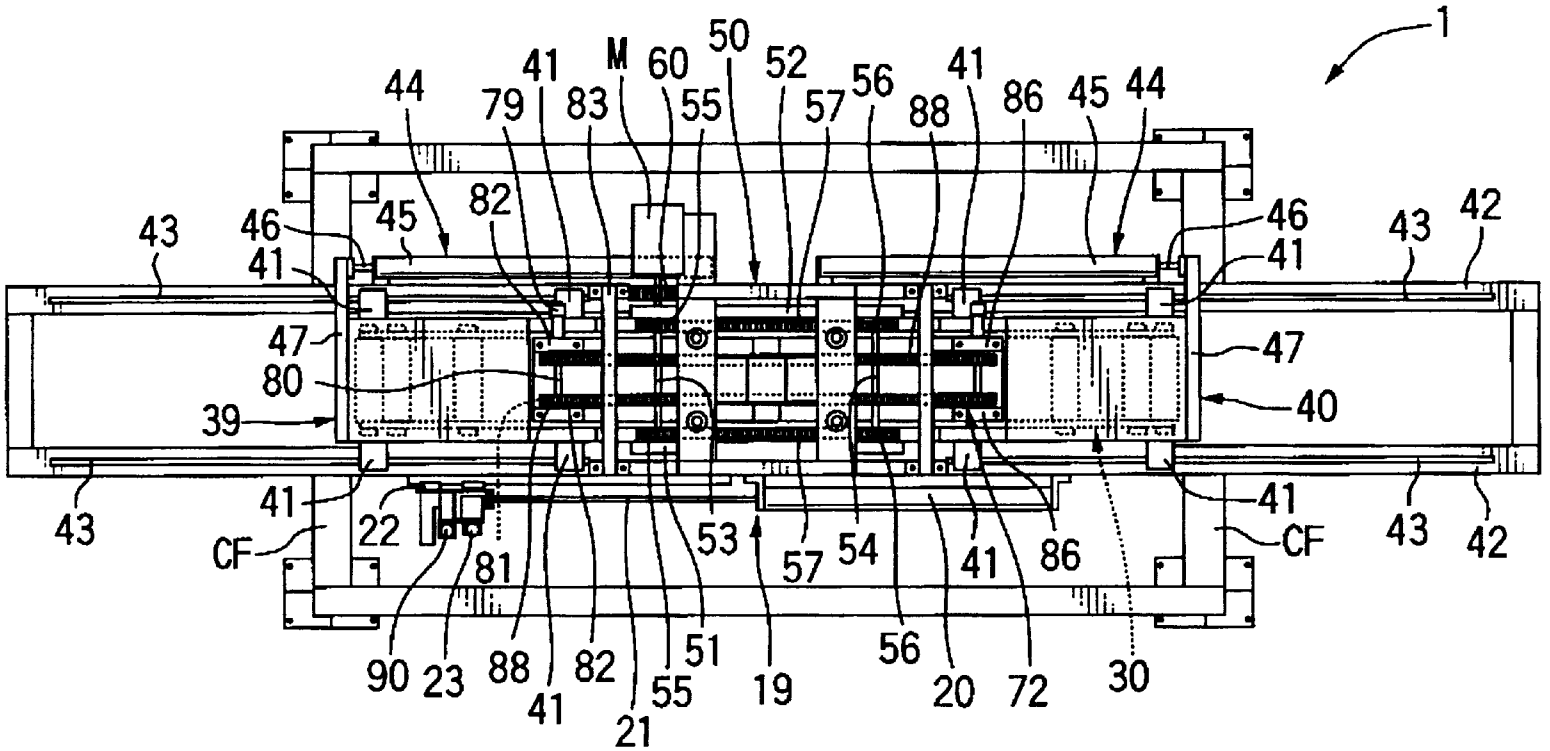
FIG. 4 is a schematic plan view of the packaging apparatus shown in FIG. 1.

As well seen in FIG. 3, a part of the guide track 31 located below the film roller chain drive 50 is constructed only of the lower wall and the sidewall, and the upper wall is removed. Therefore, the guide roller 37 guided by the guide track 31 is exposed at the removed portion of the guide track 31. As well seen in FIG. 4, a pair of supporting plates 51, 52 are fixed to the guide supporting frame 42 at the removed portion of the guide track 31 adjacent to the sidewall. There are provided a pair of rotating shafts 53, 54 extending between these supporting plates 51, 52 at a distance. The rotating shafts 53, 54 are rotatably supported by the supporting plates 51, 52, and one of the rotating shafts 53 passes through one of the supporting plates 51 and defines a pulley mounting portion.

Pulleys 55, 56 are mounted on the rotating shafts 53, 54 at the positions of the removed portions of the guide track 31 that match the exposed guide roller 37. There is routed a toothed endless drive belt 57 on each pair of the pulleys 55, 56 positioned on the same guide track 31 so as to engage frictionally with the guide roller 37 exposed at the removed portion of the guide track 31. Each pair of pulleys 55, 56 are provided with a plurality of rollers.

A second pulley 58 is mounted on the pulley mounting portion of the rotating shaft 53 described above, and a third pulley 59 mounted on the output shaft of the motor M is disposed above the second pulley 58. Then, an endless transmission belt 60 is routed on the second pulley 58 and the third pulley 59.

Therefore, when the motor M is operated and the output shaft rotates, the pulley 55 of the rotating shaft 53 is rotated via the third pulley 59, the endless transmission belt 60, and the second pulley 58. Rotation of the pulley 55 rotates the endless drive belt 57 routed on the pulley 55 and the pulley 56 on the rotating shaft 54, and thus the endless drive belt 57 in frictional engagement with the guide roller 37 exposed at the removed position of the guide track 31 leads the exposed guide roller 37 along the guide track 31 to move the entire film roller chain 32 along the guide track 31.

The packaging material supply means or the packaging material supply device 10 is disposed outside the winding device 30. The packaging material supply device 10 includes a film supply horizontal shaft 11 for rotatably holding a film roll formed of a packaging material, or an elastic film F, wound into a roll on the side of the guide track half 39. There is provided a pre-stretching device (power stretch) 12 having a plurality of rollers for stretching the elastic film F above the film supply shaft 11. A deflection roller 13 is rotatably supported above the pre-stretching device 12, and a pair of guide roller 14 is disposed between the deflection roller 13 and the guide track half 39. Each guide rollers 14 are rotatably mounted on the free end of the piston rod of the hydraulic cylinder mechanism so that the level of the film F supplied from between the guide rollers 14 can be adjusted. The film supply horizontal shaft 11 can also be displaced in the vertical direction.

Each component of the packaging material supply device 10 is mounted on the connecting-backup plate 38 of the guide track half 39 via the mounting member such as the bracket etc., not shown, so as not to interfere with the guide track half 39 when it moves laterally of the guide track half 39 so that it moves along with the guide track half 39.

The packaging material supply device 10 comprises a film chuck mechanism for transporting the film F from the guide roller 14 of the packaging material supply device 10 disposed outside the guide track 31 into the internal space IS defined by the oval guide track 31. The film chuck mechanism comprises a film chuck for clamping the film F projecting from the guide roller 14 from above and below and a film chuck drive (not shown) for moving the film chuck into and out of the internal space IS of the guide track 31.

The packaging apparatus 1 includes a packaging material cutting device, or a first heat cutter 15 and a second heat cutter 18, for cutting the film F supplied from the packaging material supply device 10.

The first heat cutter 15 is disposed between the guide roller 14 and the guide track 31 of the packaging material supply device 10 and comprises a heater line 16 and a hydraulic cylinder mechanism 17 for driving the heater line in the vertical direction.

The second heat cutter 18 is used for cutting the film F that is extending in the internal space IS of the guide track 31. As well seen in FIG. 4, the second heat cutter 18 comprises a hydraulic cylinder mechanism 19 mounted to the guide supporting frame 42 on the opposite side of the hydraulic cylinder mechanism 44. The hydraulic cylinder mechanism 19 includes a cylinder 20 fixed on the guide supporting frame 42 and a piston rod 21 moving in the cylinder 20. A bracket 22 is mounted on the distal end of the piston rod 21, and the bracket 22 is guided and supported by the guide track formed on the guide supporting frame 42 to slide along the guide track according to the expansion and contraction of the piston rod 21.

Figure 5:
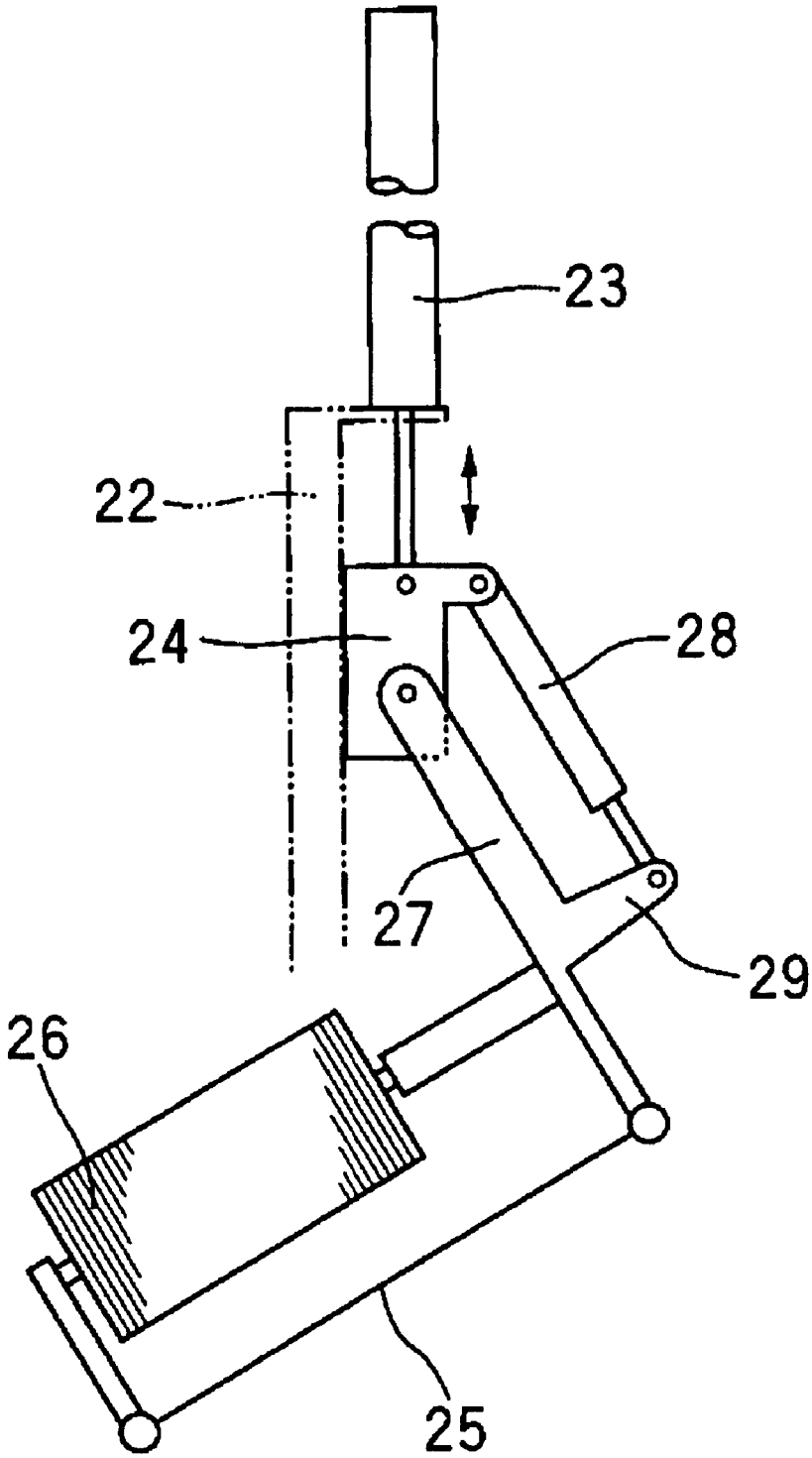
FIG. 5 is a schematic side view showing the heater line or the like that constitutes the second heat cutter of the packaging apparatus shown in FIG. 1.

As well seen in FIG. 5, a first hoisting hydraulic cylinder mechanism 23 is mounted on the bracket 22, and a bracket of a reversed L-shape 24 is fixed on the tip of the piston rod of the first hoist hydraulic cylinder mechanism 23. The upper end of the arm member 27 including a heater line 25 and the rotating brush 26 is rotatably mounted to the lower arm of the bracket 24. The upper end of the first swing hydraulic cylinder mechanism 28 is rotatably fixed to the upper arm of the bracket 24, and the lower end of the first swing hydraulic cylinder mechanism 28 is rotatably fixed to the projecting end 29 of the arm member 27.

The arm member 27 is rotated to the saved position in which the arm member 27, the heater line 25, and the rotating brush 26 are positioned outside the lateral space of the film roller chain 32 by means of the first swing hydraulic cylinder mechanism 28 when cutting of the film F is not necessary, and rotated to the cutting position in which the heater line 25 (rotating brush 26) extends along the width of the film roller 33 when cutting the film F.

Figure 6:
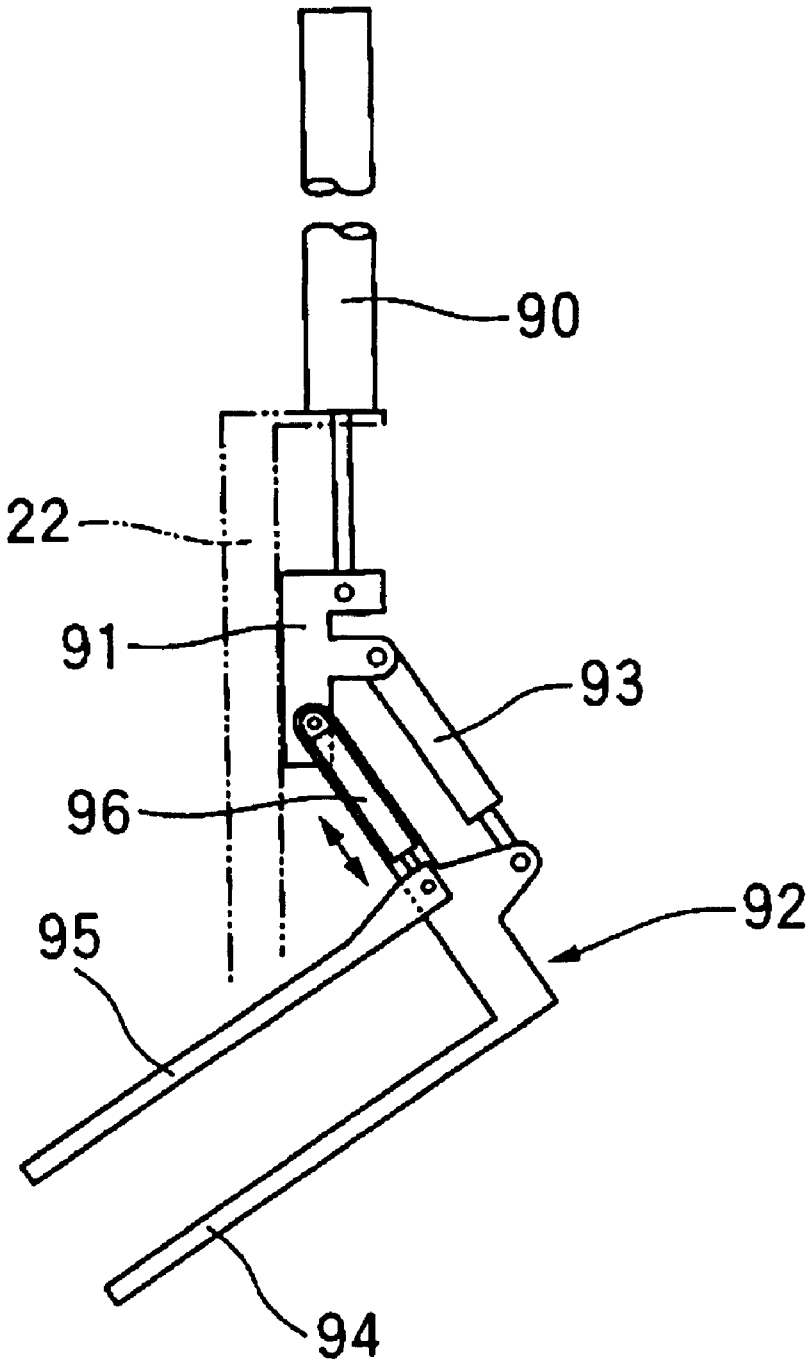
FIG. 6 is a schematic side view showing a film clump mechanism or the like of the second heat cutter of the packaging apparatus shown in FIG. 1.

As well seen in FIG. 6, a second hoist hydraulic cylinder mechanism 90 is mounted to the bracket 22 of the second heat cutter 18 described above, and the tip portion of the piston rod of the second hoist hydraulic cylinder mechanism 90 is fixed to the upper arm of the bracket 91 of generally F-shape. The upper end of the film clamp mechanism 92 is rotatably mounted to the lower arm of the bracket 91, and the upper end of the second swing hydraulic cylinder mechanism 93 is rotatably mounted to the intermediate arm of the bracket 91, and the lower end of the second swing hydraulic cylinder mechanism 93 is rotatably mounted to the film clamp mechanism 92. The film clamp mechanism 92 comprises a fixed clump member 94, a movable clump member 95, and a hydraulic cylinder mechanism for driving the clump 96 for moving the movable clump member 95 with respect to the fixed clump member 94, and the tip of the piston rod of the hydraulic cylinder mechanism for driving the clump 96 is fixed to the movable clump member 95.

The film clamp mechanism 92 is moved to the saved position in which the film clump mechanism 92 is placed laterally outside the space of the film roller chain 32 by the operation of the second swing hydraulic cylinder mechanism 93 when the clumping of the film F is not necessary, and rotated to the clumping position in which the fixed clump member 94 and the movable clump member 95 are extending along the width of the film roller 33 when clumping the film F. In such a clumping position, the movable clump member 95 is moved by the hydraulic cylinder mechanism for driving the clump 96 with respect to the fixed clump member 94, so that the film F can be clumped between the movable clump member 95 and the fixed clump member 94.

As described in detail below, in the packaging apparatus 1, the sheet steel roll S is packaged with the film F by driving the film roller chain 32 by the film roller chain drive 50, for example counter-clockwise in FIG. 1, with the tip of the film F from the guide roller 14 of the packaging material supply device 10 passed between the adjacent film rollers 33 and held temporarily by the film clamp mechanism 92 in the vicinity of the sheet steel roll S, and allowing the film F to pass through the hollow section HS of the sheet steel roll S while pressing the film F with the film roller 33A, and repeating the procedure.

In this packaging process, the slack of the film F may be generated due to the fact that the distance between the tip or the fixed tip portion of the film F and the portion of the film F being pushed by the film roller 33A always varies because the film roller 33 is driven or moved. Therefore, the packaging apparatus 1 comprises tension providing means for providing a tension to the packaging material being led by the mobile body, or a tension device to prevent the film F from being slack during packaging operation.

The tension device comprises a lower tension devices 70, 71 disposed below the guide track 31 and the upper tension device 72 disposed above the guide track 31.

The lower tension devices 70, 71 respectively comprise a common rotating drive shaft connected to the output shaft (not shown) of the air motor (not shown), and a pair of pulleys 73 mounted to the common rotating drive shaft. The common rotating drive shaft is rotatably supported by a pair of brackets 74, each of which is mounted along a part of the lower edges of the side plates of the connecting-backup plate 38 on the bottom plate extending between these side plates. The common rotating follow shaft corresponding to the above-described rotating drive shaft is rotatably supported by a pair of brackets 75 mounted to the bottom surface of each guide track 31. The common rotating follow shaft is also provided with a pair of pulleys 76. An endless tension belt 77 is routed on each pulley 76 and the corresponding pulley 73 of the common rotating drive shaft located on the opposite side therefrom.

A plurality of rotating rollers 78 are rotatably supported between the respective pulleys 73 and 76 on which the endless tension belt 77 is routed, so that the endless tension belt 77 is frictionally engaged with the film F on the film roller 33.

The upper tension device 72 comprises a common rotating drive shaft 80 connected to the output shaft (not shown) of the air motor 79 and a pair of pulleys 81 mounted to the common rotating drive shaft 80. The common rotating drive shaft 80 is rotatably supported by a pair of brackets 82, each of which is fixed to the guide supporting frame 42 via the supporting member 83 respectively.

The common rotating follow shaft 84 corresponding to the common rotating drive shaft 80 is rotatably supported by a pair of brackets 85, each of which is fixed to the guide supporting frame 42 via the supporting member 86 respectively. A pair of pulleys 87 are also mounted to the common rotating follow shaft, and an endless tension belt 88 is routed on one of the pulleys 87 and the corresponding pulley 81 of the common rotating drive shaft 80 disposed on the opposite side therefrom.

A plurality of rotating rollers 89 are rotatably supported between the respective pulleys 81 and 87 on which the endless tension belt 88 is routed, so that the endless tension belt 88 is frictionally engaged with the film F on the film roller 33. These endless tension belts 88 positioned so as to frictionally engage with the film F on the film roller 33 are disposed between the endless drive belts 57 positioned so as to frictionally engage with the guide rollers 37 on the both ends of the film roller 33.

Therefore, when the air motor 79 of the upper tension device 72 is actuated and the output shaft thereof rotates, the pulleys 73, 81 of the common rotating drive shaft 80 rotate. Rotation of the pulleys 73, 81 rotates the endless tension belt 88 routed on these pulleys and the pulleys 87 of the common rotating follow shaft 84 on the opposite direction from the rotation of the film roller chain 32, whereby the endless tension belt 88 in frictional engagement with the film F on the film roller 33 takes up the slack of the film F generated by the variation of the distance between the point of the film F wound on the sheet steel roll S bent on the sheet steel roll S and the film roller 33A. On the same principle, the lower tension devices 70, 71 are activated and take up the slack of the film F generated by the variations of the distance between the fixed tip of the film F and the film roller 33A or the like.

The air motor 79 of the upper tension device 72 and the air motors (not shown) of the respective lower tension devices 70, 71 always rotate the output shafts in the forward direction by the compressed air respectively so that a tension is applied to the film F, or so that the endless tension belt 88 and the endless tension belt 77 are rotated in the direction opposite from the direction of rotation of the film roller chain 32. However, when the sensor, not shown, detects that the film F is not loosened at each endless tension belt 77, 88, the relieve valve (not shown) is relieved to stop the forced forward rotation of the output shaft to free the output shaft.

The action (operation) of this embodiment will now be described.

First of all, as shown in FIG. 1, the sheet steel roll S is disposed so that the guide track 31 extends through the hollow section HS of the sheet steel roll S. In order to do so, the hydraulic cylinder mechanism 44 is actuated to move the guide track halves 39, 40 away from each other to produce a clearance between the guide track halves 39, 40 for receiving the sheet steel roll S. Then, the sheet steel roll S is transported toward between the guide track halves 39, 40 by a carriage (not shown) having a pair of turning rolls for rotatably supporting the lower outer periphery of the sheet steel roll S. Subsequently, the guide track halves 39, 40 are moved by the hydraulic cylinder mechanism 44 to eliminate the clearance between the guide track halves 39, 40, and the guide track halves 39, 40 are locked with respect to each other to be the state shown in FIG. 1.

Then, the tip portion of the film F pulled out from the film roll on the film supply horizontal shaft 11 and projecting out of the guide rollers 14 is clamped by the film chuck, passed through the adjacent film rollers 33 by the film chuck drive, and introduced into the internal space IS of the guide track 31. Subsequently, the tip portion of the film F gripped by the film chuck is clumped by the film clamp mechanism 92 of the second heat cutter 18, and clamp of the film F by the film chuck is released.

Clamp of the film F by the film clump mechanism 92 activates the second hoist hydraulic cylinder mechanism 90 to move the film clamp mechanism 92 to the level of the film F fed from the guide rollers 14. Then, the second swing hydraulic cylinder mechanism 93 is activated to rotate the film clamp mechanism 92 from the saved position to the clamping position, and thus the hydraulic cylinder mechanism for driving the clamp 96 is activated to clamp the tip portion of the film F between the movable clamp member 95 and the fixed clamp member 94.

Subsequently, the film clump mechanism 92 is moved to the suitable position in the vicinity of the sheet steel roll S. The film clamp mechanism 92 is moved by activating the hydraulic cylinder mechanism 19 to move the bracket 22 for supporting the film clamp mechanism 92 along the guide track of the guide supporting frame 42 and by activating the second hoist hydraulic cylinder mechanism 90 to move the film clamp mechanism 92 upward and downward.

When the film roller chain 32 is driven counter-clockwise, for example in FIG. 1, by the film roller chain drive 50 in this state, the film roller 33A from among the adjacent film rollers 33 having the film F in-between and positioned downstream in the direction of the movement of the film roller chain 32 is moved together with the film F, and consequently, the film F is pulled out of the packaging material supply device 10.

The film roller 33A passes through the hollow section HS of the sheet steel roll S with the film F hooked thereon, and makes one turn along the guide track 31. When the film roller 33A makes one turn along the guide track 31 with the film F hooked thereon, the portion of the film extending between the film roller 33A and the tip portion of the film F clamped by the film clamp mechanism 92, or the packaging film portion, packages a part of the circumferential wall of the sheet steel roll S (winds just as puttee). On the other hand, the remaining portion of the film extending between the film roller 33A and the guide roller 14, or the portion of the accumulated film, remains on the film roller 33 positioned downstream of the film roller 33A.

When the film roller 33A made almost one turn along the guide track 31 from the position of the guide roller 14, clamp of the tip of the film F by the film clamp mechanism 92 is released, and the film clamp mechanism 92 is rotated from the clamping position to the saved position. When the film roller chain 32 is driven again, the tip portion of the released film F is caught on the sheet steel roll S by the portion of the film extending between the portion of the packaging film wound about one round on the sheet steel roll S and the film roller 33A. The film F is wound on the sheet steel roll S by continuingly driving the film roller chain 32 while rotating the turning roll of the carriage supporting the sheet steel roll S to displace the circumferential wall of the sheet steel roll S with respect to the film roller chain 32.

When the film roller chain 32 is driven, the portion of the packaging film is wound around the circumferential wall of the sheet steel roll S and the accumulated film portion accumulates on the film roller 33, in other words, the accumulated film portion is wound on the film roller chain 32 itself. After the sheet steel roll S is wound by the packaging film portion prescribed number of times (though the number of times varies with the ratio between the dimension of the sheet steel roll S to be packaged and the whole length of the film roller chain 32 as a function, in this embodiment, it is preferable to wind the number of time that is needed to wind about 30% of the quantity of the film to be used to package the sheet steel roll S), the heated heater line 16 is pressed against the film F positioned between the guide roller 14 and the guide track 31 by the hydraulic cylinder mechanism 17 of the first heat cutter 15 to cut the film F.

When the film roller chain 32 is further driven in this state, the accumulated film portion of the film roller 33 is wound around the sheet steel roll S. Prior to complete consumption of the accumulated film portion from the film roller 33, the film roller 33A is stopped at the position lower than the outer peripheral surface of the sheet steel roll S in the guide track half 39. Then, the heater line 25 and the rotating brush 26 of the second heat cutter 18 is moved to the vicinity of the sheet steel roll S by the hydraulic cylinder mechanism 19 and the first hoist hydraulic cylinder mechanism 23, the film F extending between the film roller 33A and the sheet steel roll S is cut by the heater line 25, and the rear end portion of the film F extending from the sheet steel roll S is pressurized against the sheet steel roll S by the rotating brush 26 to stick on the sheet steel roll S by adhesive property of the film F.

The present invention is not limited to the embodiment described above, and various variations and modifications described below are possible.

For example, though the film roller chain 32 constituting the mobile body for leading the packaging material is driven by the film roller chain drive 50 in the embodiment described above, it is also possible to construct such a mobile body or the film roller chain 32 of a crawler type and omit the film roller chain drive 50. The crawling mechanism of the film roller chain 32 may comprises for example a motor mounted on the given film roller 33, a feeder conductor laid in the guide track 31, and a contact electric conductor connected to the motor and thus brought into contact with the feeder conductor. The mobile body may be formed of a piece of film roller 33.

Though clamping and cutting of the film F as a packaging material are made respectively by the film chuck mechanism, film clamp mechanism 92, the first heat cutter 15, and the second heat cutter 18 in the embodiment described above, it is also possible to omit these mechanism or the device by performing clamping and cutting operation for the film F manually.

Instead of the hydraulic cylinder mechanisms 17, 19, 23, 28, 44 and 90 used in the embodiment described above, an air cylinder or a power actuator, which work in the same manner as the hydraulic cylinder mechanism described above may be employed.

Preferably, the packaging apparatus 1 comprises an alignment device for moving the packaging apparatus 1 in the vertical direction so that alignment of the packaging apparatus 1 according to the size (diameter) of the object to be packaged can be performed.

INDUSTRIAL APPLICABILITY

According to the present invention, a packaging apparatus for supplying a packaging material by the packaging material supply means provided independently of the mobile body moving along the annular guide body is provided.

What is claimed is:

1. A packaging apparatus comprising a mobile body for leading a packaging material, an annular guide body for guiding said mobile body, mobile body driving means for moving said mobile body along said annular guide body, and packaging material supply means disposed outside said annular guide body, wherein said mobile body is formed of a film roller chain having a plurality of film rollers connected by connecting links with each other, the annular guide body being formed of a guide track for guiding and supporting said film roller chain, and said mobile body drive means being a driving belt for moving said film roller chain with respect to said guide track.

2. A packaging apparatus as set forth in claim 1, further comprising tension providing means for providing a tension to the packaging material lead by said mobile body.

3. A packaging apparatus as set forth in claim 2, characterized in that said tension providing means includes a tension belt to be driven by the an air motor in the opposite direction in which said mobile body moves in said annular guide body, and in that there is provided between said air motor and a compressed air supply of said air motor a relief valve for relieving compressed air from said compressed air supply when it is not necessary to provide a tension to said packaging material.

4. A packaging apparatus as set forth in claim 3, further comprising a packaging material cutting device for cutting the packaging material supplied from said packaging material supply means.

5. A packaging apparatus comprising a mobile body for leading a packaging material, an annular guide body for guiding said mobile body, mobile body driving means for moving said mobile body along said annular guide body, and packaging material supply means disposed outside said annular guide body, further comprising tension providing means for proving a tension to the packaging material lead by said mobile body;

wherein said tension providing means includes a tension belt to be driven by an air motor in the opposite direction in which said mobile body moves in said annular guide body, and in that there is provided between said air motor and a compressed air supply of said air motor a relief valve for relieving compressed air from said compressed air supply when it is not necessary to provide a tension to said packaging material.

6. A packaging apparatus as set forth in claim 5, wherein said mobile body is formed of a film roller chain having a plurality of film rollers connected by the connecting links with each other, the annular guide body being formed of a guide track for guiding and supporting said film roller chain, and said mobile body drive means being a driving belt for moving said film roller chain with respect to said guide track.

7. A packaging apparatus as set forth in claim 5, further comprising a packaging material cutting device for cutting the packaging material supplied from said packaging material supply means.

8. A packaging apparatus comprising a mobile body for leading a packaging material, an annular guide body for guiding said mobile body driving means for moving said mobile body along said annular guide body, and packaging material supply means disposed outside said annular guide body, wherein the packaging material is repeatedly held temporarily by a film clamp mechanism (92) and passes through a hollow section (HS) of a sheet steel roll (S) so as to package the sheet steel roll (S) with the packaging material.

9. A packaging apparatus as set forth in claim 8, further comprising tension providing means for proving a tension to the packaging material lead by said mobile body.

10. A packaging apparatus as set forth in claim 9, characterized in that said tension providing means includes a tension belt to be driven by an air motor in the opposite direction in which said mobile body moves in said annular guide body, and in that there is provided between said air motor and a compressed air supply of said air motor a relief valve for relieving compressed air from said compressed air supply when it is not necessary to provide a tension to said packaging material.

11. A packaging apparatus as set forth in claim 10, further comprising a packaging material cutting device for cutting the packaging material supplied from said packaging material supply means.

12. A packaging apparatus as set forth in claim 8, wherein said mobile body is formed of a film roller chain having a plurality of film rollers connected by the connecting links with each other, the annular guide body being formed of a guide track for guiding and supporting said film roller chain, and said mobile body drive means being a driving belt for moving said film roller chain with respect to said guide track.

* * * * *